US007828414B2

(12) United States Patent
Lee

(10) Patent No.: US 7,828,414 B2
(45) Date of Patent: Nov. 9, 2010

(54) HEAD ADJUSTMENT METHOD AND IMAGE FORMING APPARATUS

(75) Inventor: Ho-keun Lee, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 871 days.

(21) Appl. No.: 11/650,959

(22) Filed: Jan. 9, 2007

(65) Prior Publication Data

US 2008/0018701 A1 Jan. 24, 2008

(30) Foreign Application Priority Data

Jul. 21, 2006 (KR) ..... 10-2006-0068731

(51) Int. Cl.
*B41J 23/00* (2006.01)

(52) U.S. Cl. ..... 347/41

(58) Field of Classification Search ..... None
See application file for complete search history.

(56) References Cited

U.S. PATENT DOCUMENTS

2003/0001914 A1 1/2003 Matsumoto et al.
2004/0185693 A1 * 9/2004 Yamaguchi et al. ..... 439/79
2005/0062784 A1 3/2005 Matsuzaki et al.
2005/0099439 A1 5/2005 Folkins

FOREIGN PATENT DOCUMENTS

EP 1 479 520 A1 11/2004

OTHER PUBLICATIONS

European Search Report issued Oct. 16, 2008 in EP 07107818.2.

* cited by examiner

*Primary Examiner*—Stephen D Meier
*Assistant Examiner*—Alexander C Witkowski
(74) *Attorney, Agent, or Firm*—Stanzione & Kim, LLP

(57) ABSTRACT

A head adjustment method of adjusting overlaps of a plurality of print heads, which are arranged in a widthwise direction of a print medium in an image forming apparatus, in the widthwise direction. The head adjustment method includes setting a theoretical input pattern image to be formed by the print heads, outputting a practical output pattern image on the print medium by driving the print heads according to the input pattern image, estimating practical overlap values of the print heads through the output pattern image, and adjusting degrees of overlap between the print heads according to the estimated overlap values.

45 Claims, 10 Drawing Sheets

HEAD ADJUSTMENT METHOD AND IMAGE FORMING APPARATUS

CROSS-REFERENCE TO RELATED APPLICATIONS

This application claims priority under 35 U.S.C. §119(a) from Korean Patent Application No. 2006-68731, filed on Jul. 21, 2006, in the Korean Intellectual Property Office, the disclosure of which is incorporated herein by reference in its entirety.

BACKGROUND OF THE INVENTION

1. Field of the Invention

The present general inventive concept relates to a head adjustment method of an image forming apparatus, and more particularly, to a head adjustment method of adjusting images printed on a print medium by a plurality of independently driven heads in such a manner as to be aligned in relation to either a widthwise direction and/or a feeding direction of the print medium.

2. Description of the Related Art

In general, an image forming apparatus, such as an ink-jet printer, ejects fine droplets of print inks to desired positions on a print medium, such as a paper or a cloth, so as to print a predetermined color image on a surface of the print medium. A conventional ink-jet printer includes an ink cartridge for printing an image while reciprocating in a direction (i.e., in a widthwise direction of the print medium) that is at right angle to a feeding direction of the print medium. However, such a conventional ink-jet printer with an ink cartridge for printing an image while reciprocating across the print medium has a disadvantage in that the printing speed is very slow.

Recently, ink-jet printers have been developed to employ an ink cartridge having a plurality of print heads arranged over the entire width of a print medium, so that an image can be rapidly printed without causing the ink cartridge to reciprocate. Such ink-jet printers are also referred to as array print head type ink-jet printers.

A conventional array print head type ink cartridge includes a plurality of ink tanks, each for storing a print ink, a plurality of negative pressure adjustment units connected to the respective ink tanks, a plurality of print heads arranged in a predetermined pattern in the widthwise direction of a print medium, and an ink channel unit for supplying inks from the ink tanks to the print heads.

The ink tanks are mounted on a frame and contain various colors of inks, e.g., yellow (Y), magenta (M), cyan (C) and black (B) inks.

The negative pressure adjustment units are mounted on the underside of the frame and coupled to the respective ink tanks. Such negative pressure adjustment units produce negative pressure so as to prevent the leakage of ink.

The ink channel unit is connected with the negative pressure adjustment units and serves to supply inks discharged from the ink tanks and through the negative pressure adjustment units to each of the print heads.

The print heads are arranged in a predetermined pattern on and attached to the front face (i.e., the face that will be closest to the print medium during printing) of the ink channel unit. Each of the print heads is formed with a plurality of nozzles through which inks supplied from the ink channel unit is ejected onto a print medium, whereby an image is printed on the print medium.

Because an ink cartridge having the above-mentioned or other similar construction has a plurality of print heads, the spatial orientation or posture or geometry of the print heads may get varied when each of the print heads is assembled. In case of one or more such variations, an image printed on a paper by inks ejected from each of the print heads may be tilted or disoriented without being properly horizontally retained in the paper-feeding direction (hereinafter, to be referred to as "B" direction). In addition, when one or more print heads are misaligned in the widthwise direction of the paper (hereinafter, to be referred to as "A" direction), inks from different heads may overlap, thereby resulting in a darker spot on the paper, or misaligned heads may produce an empty space where no image is formed at a boundary area between two adjacent, but misaligned, print heads.

Therefore, it is desirable to provide a print head adjustment method in an array type inkjet printer or similar image forming apparatus for easily and rapidly aligning and adjusting the print heads.

SUMMARY OF THE INVENTION

The present general inventive concept provides an improved image forming apparatus having a plurality of print heads which can be aligned with each other through a simple method.

Additional aspects and advantages of the present general inventive concept will be set forth in part in the description which follows and, in part, will be obvious from the description, or may be learned by practice of the general inventive concept.

The foregoing and/or other aspects of the present general inventive concept may be achieved by providing a head adjustment method of adjusting overlaps of a plurality of print heads, which are arranged in a widthwise direction of a print medium in an image forming apparatus, in the widthwise direction, the method including setting a theoretical input pattern image to be formed by the print heads, outputting a practical output pattern image on the print medium by driving the print heads according to the input pattern image, estimating practical overlap values of the print heads through the output pattern image, and adjusting degrees of overlap between the print heads according to the estimated overlap values.

The setting of the theoretical input pattern may include theoretically setting discontinuous areas of neighboring widthwise unit images formed by neighboring print heads, respectively, and forming comparative unit images, which include the widthwise unit images, in such a manner that a predetermined time difference is provided between neighboring comparative unit images along a feeding direction of the print medium, wherein the discontinuous areas of neighboring comparative unit images are varied from each other.

The setting of the discontinuous areas may include determining each of the theoretical discontinuous areas between the widthwise unit images based on the assumption that there is zero (0) overlap of nozzles of neighboring print heads in the widthwise direction.

The forming of the comparative unit images may include setting the discontinuous areas of neighboring comparative unit images to be spaced from each other by an individual nozzle unit of the print heads.

The setting of the theoretical input pattern may include introducing a boundary line, which is representative of a boundary between the widthwise unit images of each of the comparative unit images, into the input pattern image.

The setting of the discontinuous areas may include introducing numerical values, each of which is representative of a unit of a discontinuous area of each of the comparative unit images, into the input pattern image.

The estimating of the practical overlap values of the print heads may include selecting a widthwise unit image having a minimum overlap among the comparative unit images of the output pattern image, selecting a comparative unit image having a minimum discontinuous area among the comparative unit images of the output pattern image, selecting a comparative unit image corresponding to an intermediate position between the comparative image having the minimum overlap and the comparative unit image having the minimum discontinuous area, and determining the discontinuous area of the comparative unit image of the selected intermediate position as a practically referenced discontinuous area.

The output pattern image may include numerical values, each of which is indicative of a unit of a discontinuous area of each of the outputted comparative unit images.

The determining of the discontinuous may include adjusting a numerical value indicated as corresponding to the comparative unit image of the intermediate position as a practical discontinuous area of corresponding neighboring heads.

The comparative images of the output pattern image may include color images, each of which is provided in a form of a bar in the widthwise direction.

The foregoing and/or other aspects of the present general inventive concept may also be achieved by providing a head adjustment method of adjusting a plurality of print heads arranged in an widthwise direction in an image forming apparatus in such a manner that unit images formed by the print heads are coincidently connected with each other in a feeding direction of a print medium, the method including setting a theoretical input pattern image to be formed by the print heads, outputting a practical output pattern image on the print medium by driving the print heads according to the input pattern image, estimating relative positions of the print heads in the feeding direction through the output pattern image, and adjusting positions of the print heads in the feeding direction according to the estimated relative positions.

The setting of the theoretical input pattern image may include setting any one of the print heads as a reference head, setting a plurality of reference lines to be formed at intervals in the feeding direction by the reference head, setting a plurality of comparative lines to be formed in the feeding direction by another one of the print heads next to the reference head so as to be compared with the reference head, in such a manner that the comparative lines have phases in relation to the neighboring reference lines in the feeding direction, the phases of neighboring comparative lines being different from each other in a predetermined unit, and numerically expressing and setting phase differences of the phases of the comparative lines next to the reference lines, so that numerical values of the phase differences are indicated in the input pattern image.

The setting of the plurality of comparative lines may include setting the comparative lines to be formed by the head next to the reference head in such a manner as to be classified into minus phase difference lines and plus phase difference lines that are positioned before and after a center line in the feeding direction, respectively, the center line being coincident with a corresponding one of the reference lines.

The plus and minus phase differences may be set to be increased by a predetermined unit according to a distance from the central comparative line.

The setting of the theoretical input pattern image may further include setting a plurality of second comparative lines having second phase differences which are different from each other in the feeding direction, and setting the second phase differences of the print heads next to each other to be numerically expressed.

The estimating of the relative positions of the print heads may include selecting one of the second comparative lines which is most horizontal in relation to a corresponding reference line, finding a numerical value corresponding to the selected comparative line to calculate the relative positions between the reference head and the neighboring print heads, selecting the second comparative lines which are most horizontal to each other between the neighboring print heads, calculating the relative positions between the neighboring heads on the basis of numerical values corresponding to the second comparative lines selected between the neighboring heads, and calculating another relative positions between the reference head and the other print heads next to the reference head in the widthwise direction on the basis of the calculated relative positions.

The estimating of the relative positions of the print heads may include selecting a comparative line which is most horizontal in relation to a corresponding reference line, and finding a numerical value corresponding to the selected comparative line to calculate the relative positions between the reference head and neighboring heads.

The foregoing and/or other aspects of the present general inventive concept may also be achieved by providing a head adjustment method of adjusting a plurality of print heads arranged in an image forming apparatus in a widthwise direction of a print medium, the method including adjusting overlaps of the print heads in the widthwise direction, and adjusting relative positions between the print heads in a feeding direction of the print medium.

The adjusting of the overlaps may include setting a theoretical input pattern image to be formed by the print heads, outputting a practical output pattern image on the print medium by driving the print heads according to the input pattern image, estimating practical overlap values of the print heads through the output pattern image, and adjusting degrees of overlap between the print heads according to the estimated overlap values.

The setting of the theoretical input pattern image may include theoretically setting discontinuous areas of neighboring widthwise unit images formed by neighboring print heads, respectively, and forming comparative unit images, which include the widthwise unit images, in such a manner that a predetermined time difference is provided between neighboring comparative unit images along a feeding direction of the print medium, wherein the discontinuous areas of neighboring comparative unit images are varied from each other.

The setting of the discontinuous areas may include determining each of the theoretical discontinuous areas between the widthwise unit images based on the assumption that there is zero (0) overlap of nozzles of neighboring print heads in the widthwise direction.

The setting of the discontinuous areas may further include introducing a boundary line, which is representative of a boundary between the widthwise unit images of each of the comparative unit images, into the input pattern image.

The setting of the discontinuous areas may further include introducing numerical values, each of which is representative of a unit of a discontinuous area of each of the comparative unit images, into the input pattern image.

The estimating of the practical overlap values of the print heads may include selecting a widthwise unit image having a minimum overlap among the comparative unit images of the output pattern image, selecting a comparative unit image having a minimum discontinuous area among the comparative unit images of the output pattern image, selecting a comparative unit image corresponding to an intermediate position between the comparative image having the minimum overlap and the comparative unit image having the minimum discontinuous area, and determining a discontinuous area of the comparative unit image of the selected intermediate position as a practically referenced discontinuous area.

The output pattern image may include numerical values, each of which is indicative of a unit of a discontinuous area of each of the outputted comparative unit images.

The adjusting of the relative positions may include setting a theoretical second input pattern image to be formed by the print heads, outputting a practical second output pattern image on the print medium by driving the print heads according to the second input pattern image, estimating relative positions of the print heads in the print medium feeding direction through the second output pattern image, and adjusting positions of the print heads in the print medium feeding direction according to the estimated relative positions.

The setting of the theoretical second input pattern image may include setting one of the print heads as a reference head, setting a plurality of reference lines to be formed at intervals in the feeding direction by the reference head, setting a plurality of comparative lines to be formed in the feeding direction by another one of the print heads next to the reference head so as to be compared with the reference head, in such a manner that the comparative lines have phases in relation to the neighboring reference lines in the feeding direction, the phases of neighboring comparative lines being different from each other in a predetermined unit; and b14) numerically expressing and setting phase differences of the phases of the comparative lines next to the reference lines, so that numerical values of the phase differences are indicated in the second input pattern image.

The setting of the plurality of comparative lines may include setting the comparative lines to be formed by the head next to the reference head to be classified into minus phase difference lines and plus phase difference lines that are positioned before and after a center line in the feeding direction, respectively, the center line being coincident with a corresponding one of the reference lines.

The plus and minus phase differences may be set in such a manner as to be increased by a predetermined unit according to a distance from the central comparative line.

The setting of the theoretical second input pattern image may further include setting a plurality of second comparative lines having second phase differences of second phases which are different from each other in the feeding direction, and setting the second phase differences of the print heads next to each other to be numerically expressed.

The estimating of the relative positions of the print heads may include selecting one of the second comparative lines which is most horizontal in relation to a corresponding reference line, finding a numerical value corresponding to the selected second comparative line to calculate relative positions between the reference head and the neighboring heads, selecting the second comparative lines which are most horizontal to each other between the neighboring heads, calculating the relative positions between the neighboring heads on the basis of numerical values corresponding to the comparative lines selected between the neighboring heads, and calculating another relative positions between the reference head and the another heads next to the reference head in the widthwise direction on the basis of the calculated relative positions.

The estimating of the relative positions of the print heads may include selecting one of the comparative lines which is most horizontal in relation to a corresponding reference line, and finding a numerical value corresponding to the selected comparative line to calculate the another relative positions between the reference head and the neighboring heads.

In addition, it is preferable that the print heads are arranged in an array type.

The foregoing and/or other aspects of the present general inventive concept may also be achieved by providing head adjusting method of adjusting a plurality of print heads arranged in an image forming apparatus in a widthwise direction of a print medium, the method including setting a first input pattern image indicating overlaps of the print heads in the widthwise direction of the print medium and a second input pattern image indicating relative positions of the print heads in a feeding direction of the print medium.

The head adjustment method may further include outputting a first output pattern image and a second output pattern image on the print medium by driving the print heads according to the first input pattern image and the second input pattern image, respectively, to indicate actual overlaps of the print heads in the widthwise direction and actual relative positions of the print heads in the feeding direction.

The head adjustment method may further include adjusting the actual overlaps and the actual relative positions of the print heads.

The first input pattern image may include unit comparative images having a boundary between the adjacent print heads in the widthwise direction, and the second input pattern image comprises comparative lines disposed in the feeding direction.

The first input pattern image may include a first unit comparative image formed by a portion of one of the print heads, and a second unit comparative image formed by a portion of the other one of the print heads disposed adjacent to the one of the print heads such that the first unit comparative image and the second unit comparative image are disposed opposite to each other with respect to a boundary line without a discontinuous area.

The head adjustment method may further include outputting a first output pattern image on the print medium by driving the print heads according to the first input pattern image, and the first output pattern image includes the discontinuous area around the boundary line according to an arrangement state of the print heads in the widthwise direction.

The second input pattern image may include first comparative lines disposed in the feeding direction to correspond to one of the print heads, and second comparative lines disposed in the feeding direction to correspond to the other one of the print heads disposed adjacent to the one of the print heads such that corresponding first and second comparative lines are in line with each other in the widthwise direction.

The head adjustment method may further include outputting a second output pattern image on the print medium by driving the print heads according to the second input pattern image, and the second output pattern image comprises actual first comparative lines and actual second comparative lines, and corresponding actual first and second comparative lines are spaced-apart from each other to indicate an arrangement state of the print heads in the feeding direction.

The foregoing and/or other aspects of the present general inventive concept may also be achieved by providing a head adjusting method of adjusting a plurality of print heads arranged in an image forming apparatus in a widthwise direction of a print medium, the method including outputting an output pattern image to indicate overlaps states of the print heads, wherein the output pattern image may include a first unit comparative image formed by a portion of one of the print heads, and a second unit comparative image formed by a portion of the other one of the print heads disposed adjacent to the one of the print heads such that the first unit comparative image and the second unit comparative image are disposed opposite to each other with respect to a boundary line with a discontinuous area to indicate an arrangement state of the print heads in the widthwise direction.

The foregoing and/or other aspects of the present general inventive concept may also be achieved by providing a head adjusting method of adjusting a plurality of print heads arranged in an image forming apparatus in a widthwise direction of a print medium, the method including outputting an output pattern image to indicate relative position states of the print heads, wherein the output pattern image may include first comparative lines disposed in the feeding direction to correspond to one of the print heads, and second comparative lines disposed in the feeding direction to correspond to the other one of the print heads disposed adjacent to the one of the print heads such that corresponding ones of the first and second comparative lines are formed to have a distance in the feeding direction to indicate the relative position states of the print heads.

The foregoing and/or other aspects of the present general inventive concept may also be achieved by providing a head adjusting method of adjusting a plurality of print heads arranged in an image forming apparatus in a widthwise direction of a print medium, the method including outputting a first output pattern image and a second output pattern image on the print medium by driving the print heads to indicate actual overlaps of the print heads in the widthwise direction and actual relative positions of the print heads in the feeding direction.

The foregoing and/or other aspects of the present general inventive concept may also be achieved by providing image forming apparatus including a feeding unit to feed a print medium, an ink cartridge having a print heads arranged in a widthwise direction of the printing medium, and a control unit to control the print heads to output an output pattern image to indicate overlaps states of the print heads, wherein the output pattern image comprises a first unit comparative image formed by a portion of one of the print heads, and a second unit comparative image formed by a portion of the other one of the print heads disposed adjacent to the one of the print heads such that the first unit comparative image and the second unit comparative image are disposed opposite to each other with respect to a boundary line with a discontinuous area to indicate an arrangement state of the print heads in the widthwise direction.

The foregoing and/or other aspects of the present general inventive concept may also be achieved by providing image forming apparatus including a feeding unit to feed a print medium, an ink cartridge having a print heads arranged in a widthwise direction of the printing medium, and a control unit to control the print heads to output an output pattern image to indicate relative position states of the print heads, wherein the output pattern image comprises first comparative lines disposed in the feeding direction to correspond to one of the print heads, and second comparative lines disposed in the feeding direction to correspond to the other one of the print heads disposed adjacent to the one of the print heads such that corresponding ones of the first and second comparative lines are formed to have a distance in the feeding direction to indicate the relative position states of the print heads.

The foregoing and/or other aspects of the present general inventive concept may also be achieved by providing image forming apparatus including a feeding unit to feed a print medium, an ink cartridge having a print heads arranged in a widthwise direction of the printing medium, and a control unit to control the print heads to output a first output pattern image and a second output pattern image on the print medium by driving the print heads to indicate actual overlaps of the print heads in the widthwise direction and actual relative positions of the print heads in the feeding direction.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
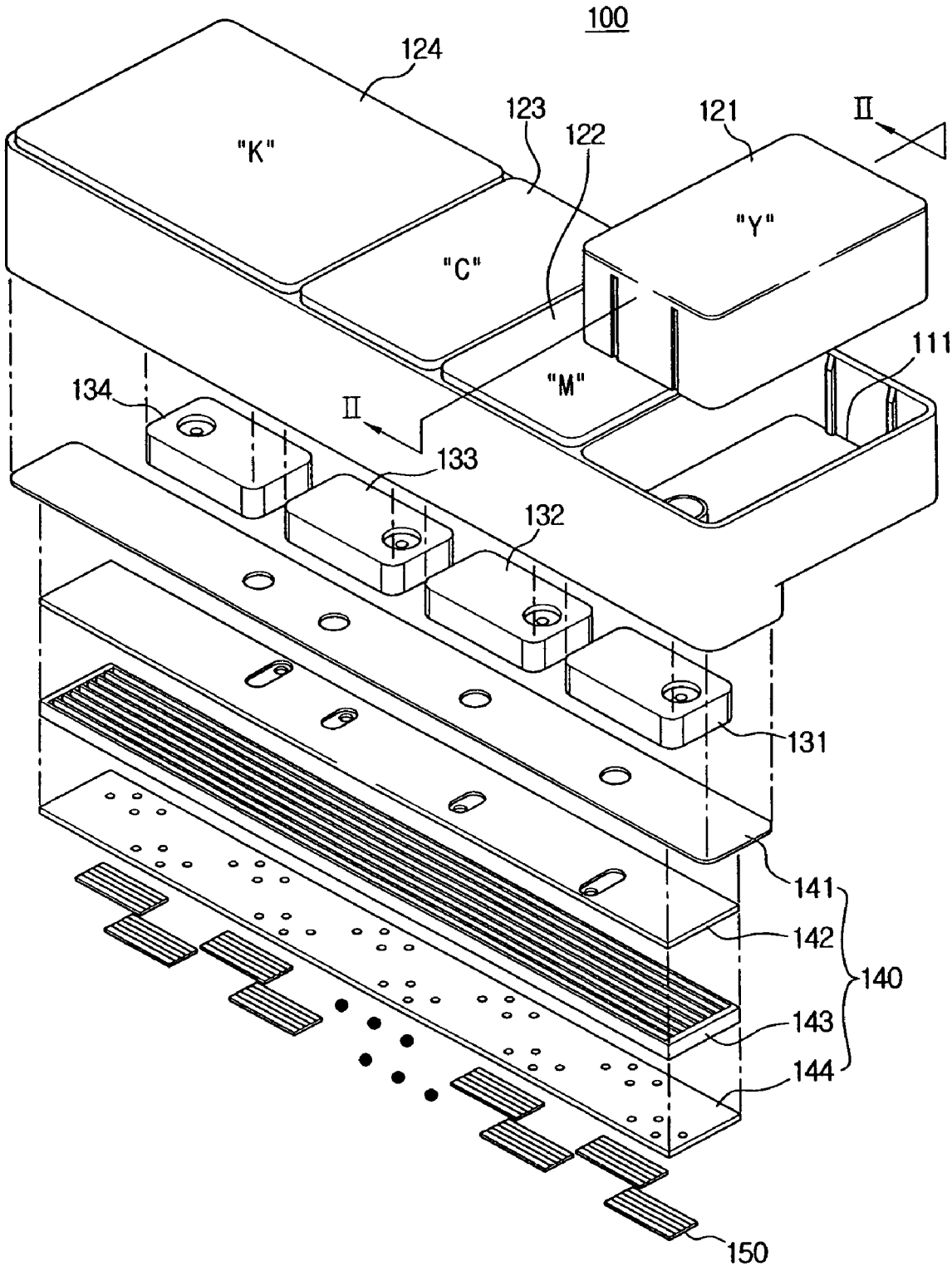
FIG. 1 is an exploded perspective view illustrating an array head type ink cartridge to explain a head adjustment method according to an embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain in order to explain the present general inventive concept by referring to the figures.

In the following description, well-known functions or constructions are not described in detail since they would obscure the invention in unnecessary detail.

Figure 2:
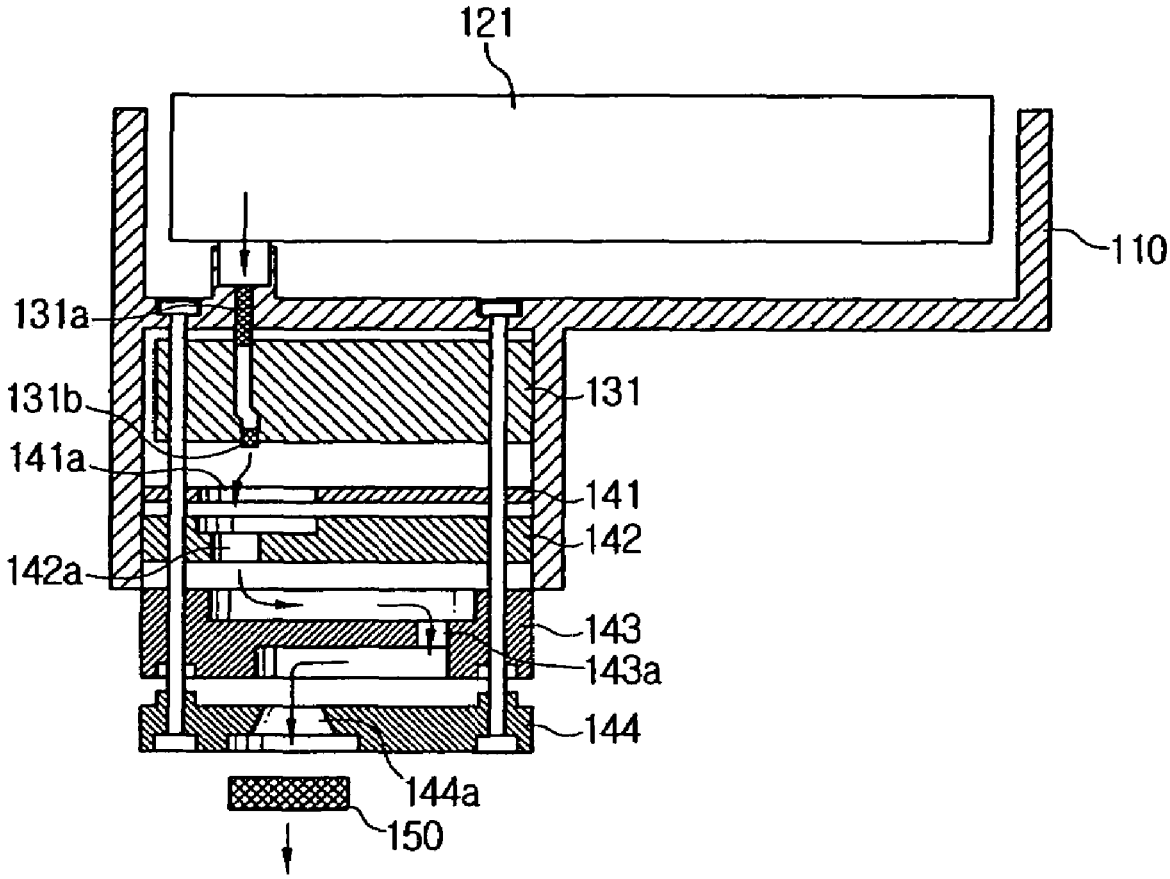
FIG. 2 is a cross-sectional view taken along line II-II in FIG. 1.

FIG. 1 is an exploded perspective view showing an array head type ink cartridge to explain a head adjustment method according to an embodiment of the present general inventive concept, and FIG. 2 is a cross-sectional view taken along line II-II in FIG. 1, wherein the drawings are provided so as to describe a construction of an image forming apparatus (e.g., an ink-jet printer) (not shown) prior to describing the head adjustment methods of an image forming apparatus according to different embodiments of the present general inventive concept. It is noted here that an image forming apparatus may include a stand-alone inkjet printer or a PC (Personal Computer)-driven inkjet printer, or may be of an array type inkjet printer.

An ink-jet printer is a printing machine which ejects fine droplets of print inks to desired positions on a print medium, such as a paper or a cloth, thereby printing a predetermined color image on a surface of the print medium. Such an ink-jet printer comprises an ink cartridge 100 (FIG. 1) to contain inks and to eject the contained inks through print heads 150. The ink cartridge 100 is mounted with a plurality of print heads 150, which are arranged all over the width of a print medium, for example, a paper.

The ink cartridge 100 illustrated in FIG. 1 may include a plurality of ink tanks 121, 122, 123 and 124 to store print inks, a plurality of negative pressure adjustment units 131, 132, 133 and 134 which are connected with the ink tanks 121, 122, 123 and 124, respectively, the plurality of print heads 150 arranged in a predetermined pattern in the widthwise direction of the print medium, and an ink channel unit 140 to supply inks to the print heads 150 from the ink tanks 121, 122, 123 and 124.

The ink tanks 121, 122, 123 and 124 are mounted in a frame 110 (See FIG. 2) of the ink-jet printer. Such ink tanks 121, 122, 123 and 124 contain various colors of inks, for example, yellow (Y), magenta (M), cyan (C) and black (B) inks, respectively.

The frame 110 has a plurality of tank mounting parts 111, in which the corresponding ink tanks 121, 122, 123 and 124 are mounted.

The negative pressure adjustment units 131, 132, 133 and 134 are mounted on an underside of the frame 110 in such a manner as to be coupled to and operatively communicate with the ink tanks 121, 122, 123 and 124, respectively. Such negative pressure adjustment units 131, 132, 133 and 134 produce a negative pressure so as to prevent the leakage of the inks. As an example, the negative pressure adjustment unit 131 may include inlet 131*a* and an outlet 131*b* (FIG. 2) to communicate with the ink tank 121 and the ink channel 141, respectively.

The ink channel unit 140 is connected with the negative pressure adjustment units 131, 132, 133 and 134 and serves to supply inks, which are admitted into the ink channel unit 140 from the ink tanks 121-124 and through the negative pressure adjustment units 131, 132, 133 and 134. The inks are then sent to each of the print heads 150.

Such an ink channel unit 140 may be manufactured using a plurality of channel plates 141, 142, 143 and 144, which are stacked and joined with each other. Among the channel plates 141, 142, 143 and 144, the channel plate 141 that may be connected with the negative pressure adjustment units 131, 132, 133 and 134 may be a pressure plate. In one embodiment of the present general inventive concept, the ink channel unit 140 may be formed by sequentially stacking three channel plates, i.e., a first channel plate 142, a second channel plate 143, and a third channel plate 144, as illustrated in FIG. 1. In this embodiment, the pressure plate 141 may be omitted. In an alternative embodiment, the ink channel unit 140 may include just two channel plates. In a still further embodiment, the ink channel unit 140 may include four or more channel plates as desired by the inkjet cartridge designer.

As illustrated in FIG. 2, the above-mentioned channel plates 141, 142, 143 and 143 have channels 141*a*, 142*a*, 143*a* and 144*a*, respectively, through which inks flow. The channels 141*a*, 142*a*, 143*a* and 144*a* are arranged in such a manner that each of the channels 141*a*, 142*a*, 143*a*, and 144*a* is provided with one color ink.

Figure 3A:
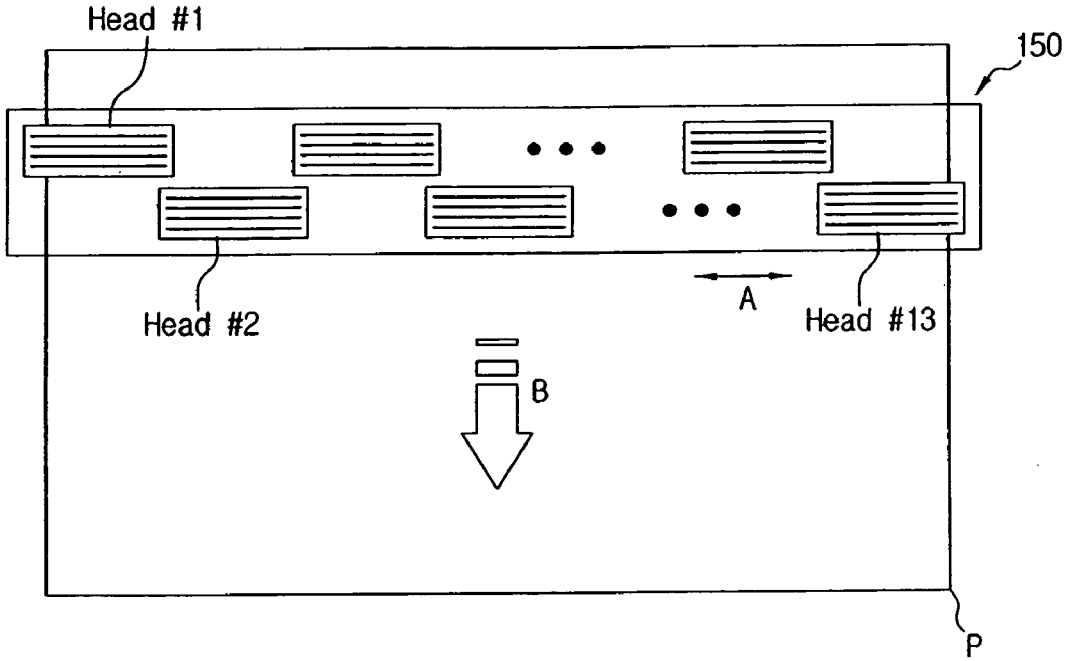
FIGS. 3A and 3B are simplified plan views illustrating the arrangement of array type print heads and their nozzles in the ink cartridge of FIG. 1.
Figure 3B:
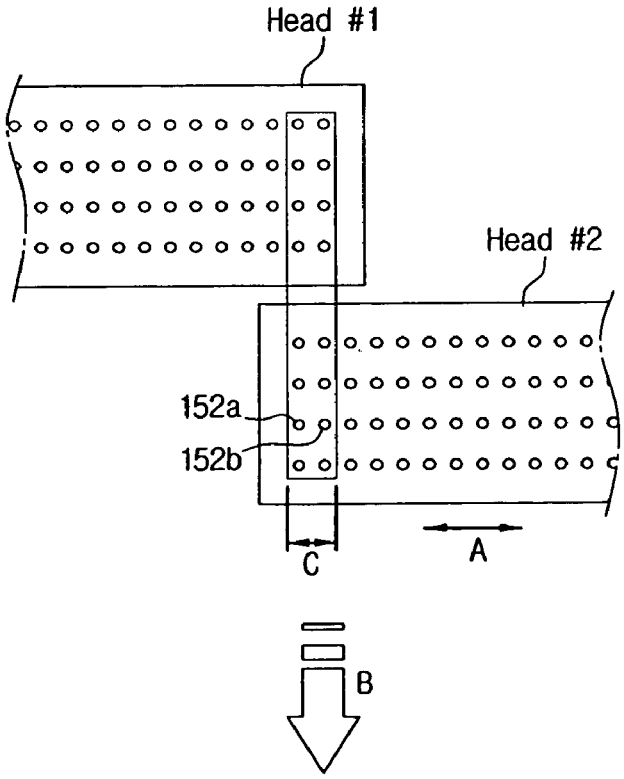

FIGS. 3A and 3B are simplified plan views illustrating the arrangement of array type print heads and their nozzles in the ink cartridge of FIG. 1. As illustrated in FIG. 3A, the print heads 150 are partially overlapped in a widthwise direction A of a print medium (e.g., the paper P). By arranging neighboring print heads (e.g., the Head #1 and the Head #2) to be partially overlapped in the widthwise direction A, it is possible to prevent occurrence of discontinuous areas in an image outputted on the paper P in the widthwise direction.

More particularly, among the respective print heads Head #1 to Head #13 in the exemplary embodiment of FIG. 3A, neighboring heads (e.g., Head #1 and Head #2) may be arranged in such a manner that some nozzles (e.g., nozzles 151*a*, 151*b* and 152*a*, 152*b* in FIG. 3B) in the plurality of nozzles in each of the print heads Head #1 and Head #2 are overlapped in the widthwise direction A. Because the nozzles 151*a*, 151*b* and 152*a*, 152*b* of the print heads Head #1 and Head #2 are overlapped in the widthwise direction A, it is possible to prevent the image outputted on the paper P from having a discontinuous area in the widthwise direction A.

Meanwhile, if all the overlapped nozzles 151*a*, 152*b* and 152*a*, 152*b* eject inks simultaneously, the image density at the location of ink ejection on paper P becomes dark in an overlapped area C (FIG. 3B). Therefore, in one embodiment, a controller to control each of the print heads (e.g., Head #1 to Head #13 in the embodiment of FIG. 3A) controls the operation of the overlapped nozzles 151*a*, 151*b* and 152*a*, 152*b* in such a manner that only the nozzles 152*a* and 152*b* are driven at the overlapped area C so as to eject inks, and the other overlapped nozzles 151*a* and 151*b* do not eject ink.

However, because the print heads 150 arranged in the widthwise direction are components of high precision and each of the print heads 150 has several hundreds of nozzles, the overlapped area C of two neighboring print heads (i.e., the number of overlapped nozzles) may get varied due to designing and assembling tolerances or the like. Therefore, if the overlapped area or the number of overlapped nozzles in two neighboring/adjacent print heads is not known, it may be difficult for the controller to normally control the quantity of inks to be ejected at the overlapped areas of the respective print heads (e.g., Head #1 to Head #13). Therefore, it may be desirable to set overlapped areas of the neighboring print heads 150, and more particularly, to set the overlapped nozzles, so that each of the print heads 150 is specifically controlled to unitize an overlapped area, for example, the number of the overlapped nozzles.

The present embodiment of the present general inventive concept relates to a method of adjusting overlapped areas in the widthwise direction A of the respective print heads 150. This method is now described in detail.

When it is needed to initially set or reset overlapped areas of the print heads (e.g., Head #1 to Head #13) when a product (e.g., the array type ink-jet printer) is delivered from a warehouse, when the product is repaired by a service person or a user due to a trouble, or when at least one print head of the product is changed, a pattern image, which is previously determined in a theoretical manner and stored as a predetermined pattern, is set (hereinafter, this pattern image is referred to as the first input pattern image). The first input pattern image may be previously set when the product is delivered from the warehouse, and may be provided in the form of image data stored in the product's memory. The first input pattern image may be provided either from a memory incorporated in a corresponding image forming apparatus (e.g., an array type inkjet printer) or through a driver of the image forming apparatus.

Figure 4A:
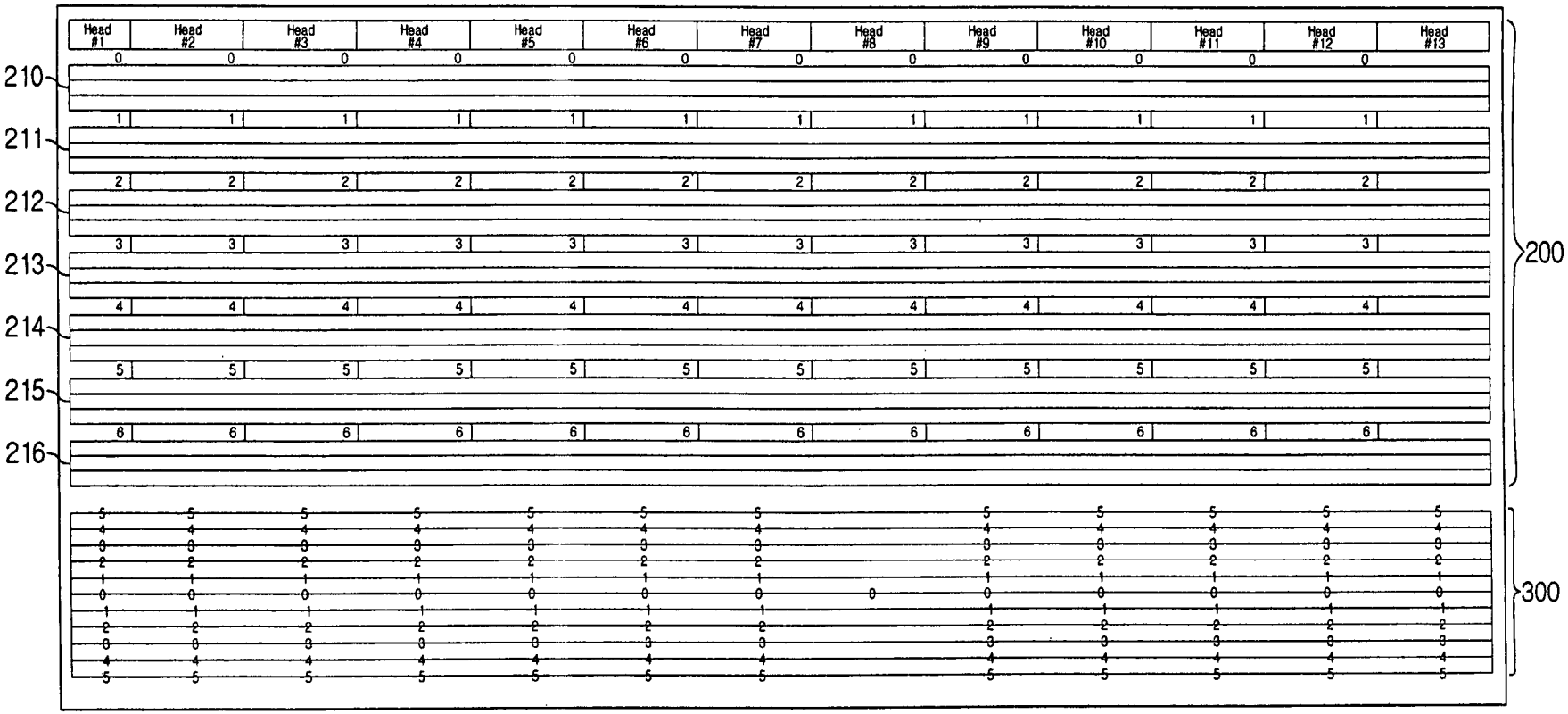
FIG. 4A illustrates a first input pattern image and a second input pattern image according to one embodiment of the present general inventive concept.
Figure 4B:
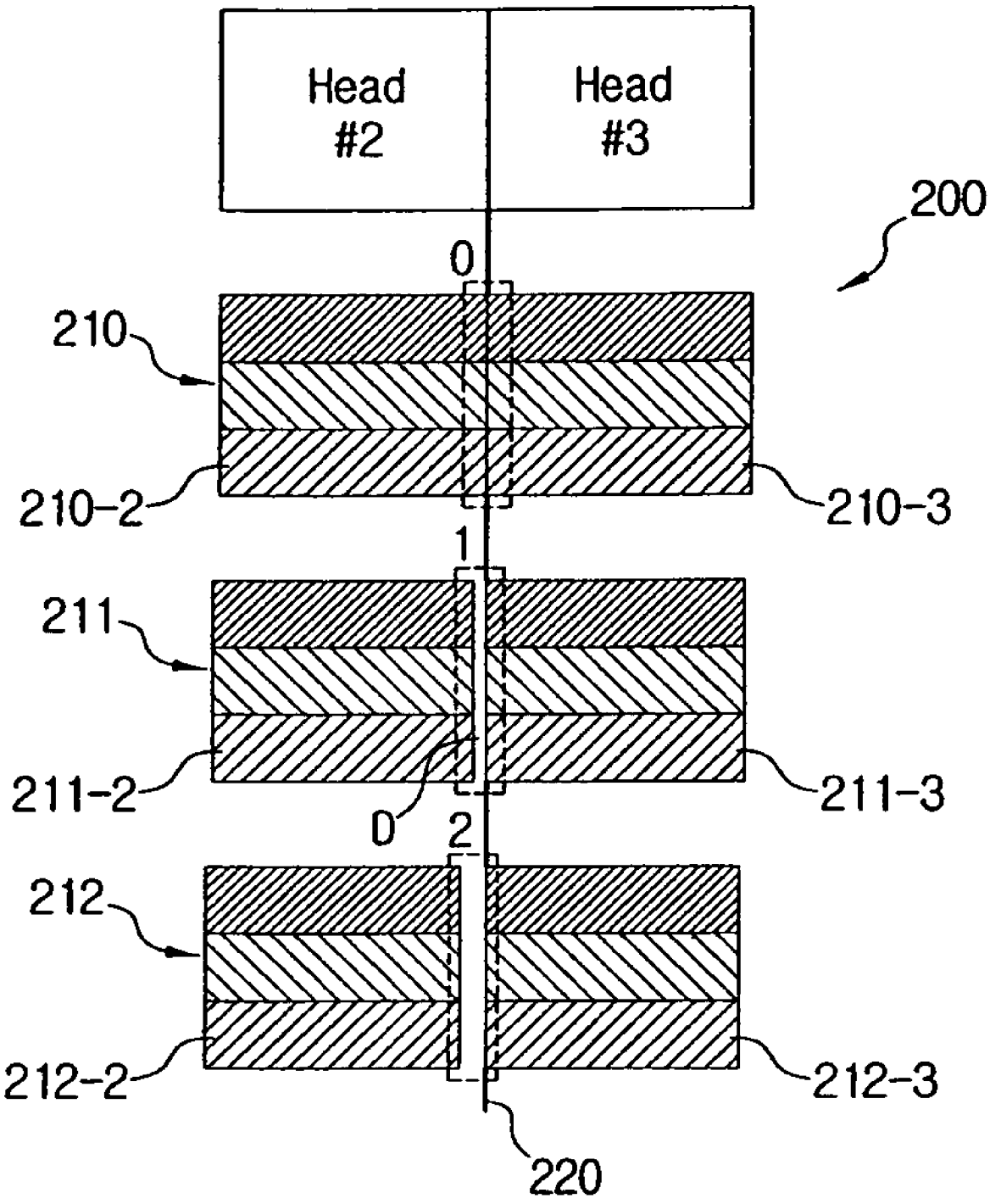
FIG. 4B is an enlarged view of a part of the first input pattern image of FIG. 4A.

FIG. 4A illustrates a first input pattern image 200 and a second input pattern image 300 according to one embodiment of the present general inventive concept, and FIG. 4B is an exemplary enlarged view of a part of the first input pattern image 200 of FIG. 4A. In FIG. 4A, the first input pattern image 200 is shown to include unit comparative images 210 to 216 formed in the widthwise direction A by the respective print heads Head #1 to Head #13, for example, and spaced from each other by a predetermined distance in the paper feeding direction B. In FIG. 4A, a plurality of exemplary print heads (designated as Head #1 to Head #13) are classified into a first head Head #1, a second head Head #2, . . . and a thirteenth head Head #13, and the respective unit comparative images 210 to 216 may constitute color images. Each such color image may be indicated in the form of a bar. In the embodiment of FIG. 4A, each exemplary unit comparative image 210-216 may constitute three color bars. Referring to FIG. 4B, which is extracted from FIG. 4A, each of the unit comparative images 210, 211 and 212 therein is shown to include a pair of widthwise unit images 210-2, 210-3; 211-2, 211-3; and 212-2, 212-3, respectively, to be independently formed by the neighboring second and third heads Head #2 and Head #3, respectively. It is noted here that only a portion of each unit comparative image 210-212 is illustrate in FIG. 4B for ease of illustration and discussion. However, each unit comparative image 210-216 may include many more such pairs of widthwise unit images (corresponding to each pair of neighboring print heads) as is evident from the configuration of the exemplary first input pattern image 200 in FIG. 4A.

The above-mentioned first input pattern image 200 corresponds to a theoretical input value, which is theoretically set by assuming that the image outputted by two neighboring print heads, for example, the second and third heads Head #2 and Head #3, is the first comparative image 210 as shown in FIG. 4B. That is, the first comparative image 210 formed by the neighboring second and third heads Head #2 and Head #3 is theoretically set as being representative of a mechanical condition of an arrangement of the neighboring heads Head #2 and Head #3 in which an overlapped area or a discontinuous area is not included The second, third, . . . , and sixth comparative images 211-215, respectively, are similarly set to have different discontinuous areas, respectively. As shown in FIG. 4B, each of the comparative images 210-216 of the first input pattern image 200 is provided with a boundary line 220 indicating a boundary between the corresponding neighboring heads (e.g., Head #2 and Head #3), and the boundary line 220 is thus also representative of the boundary between the pairs of widthwise unit images (e.g., the pair 210-2 and 210-3, or the pair 212-2 and 212-3, etc.) in each corresponding comparative unit image (e.g., the image 210, 212, etc.). Each of the comparative images 210-216 is provided in such a manner that a unit value (e.g., a numerical value), which is indicative of a representative discontinuous area D in the widthwise direction A, can be numerically indicated. In FIGS. 4A and 4B, the numerical values are indicated by 0, 1, 2, 3 . . . , which can be understood as indicating the number of overlapped nozzles or unit discontinuous areas D set between the neighboring heads (e.g., Head #2 and Head #3 in FIG. 4B). In one embodiment, the discontinuous areas among the comparative images 210-216 may vary in size and/or location (e.g., with reference to the boundary line 220).

Meanwhile, on the basis of the first input pattern image 200, which is set on the basis of the above-mentioned theoretical values, the operation of each of the print heads Head #1 to Head #13 is controlled as described hereinbelow, so that a practical output pattern image is outputted on the paper P.

Because the inputted first input pattern image 200 is a theoretically set data, it may be different from the practically output pattern image. However, because the output pattern image is based on and derived from the theoretical input pattern image 200, it is possible to correct or reset the overlapped area of the pairs of neighboring heads (e.g., Head #2 and Head #3 of FIG. 4B) using the output pattern image as discussed hereinbelow.

Figure 5A:
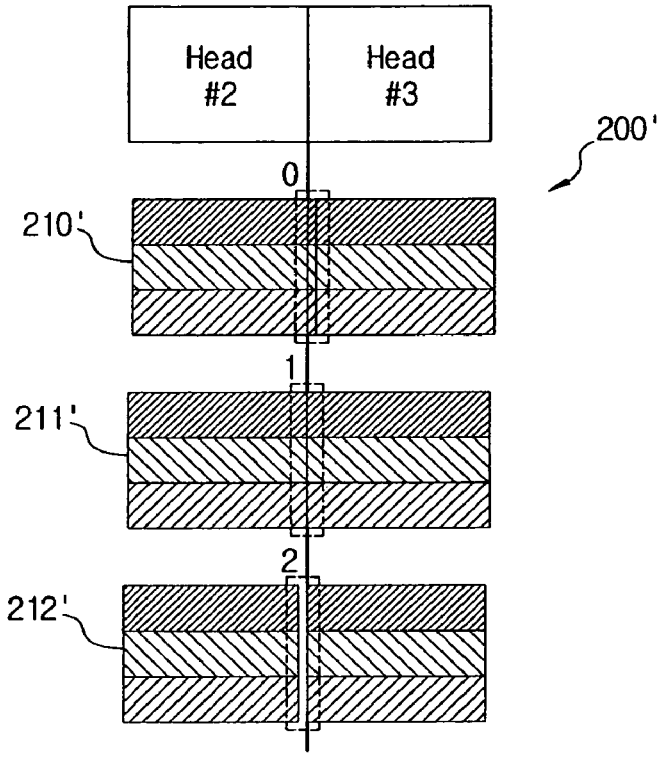
FIG. 5A shows an enlarged view of a part of a first output pattern image corresponding to the enlarged view of a part of the input pattern image in FIG. 4B.
Figure 5B:
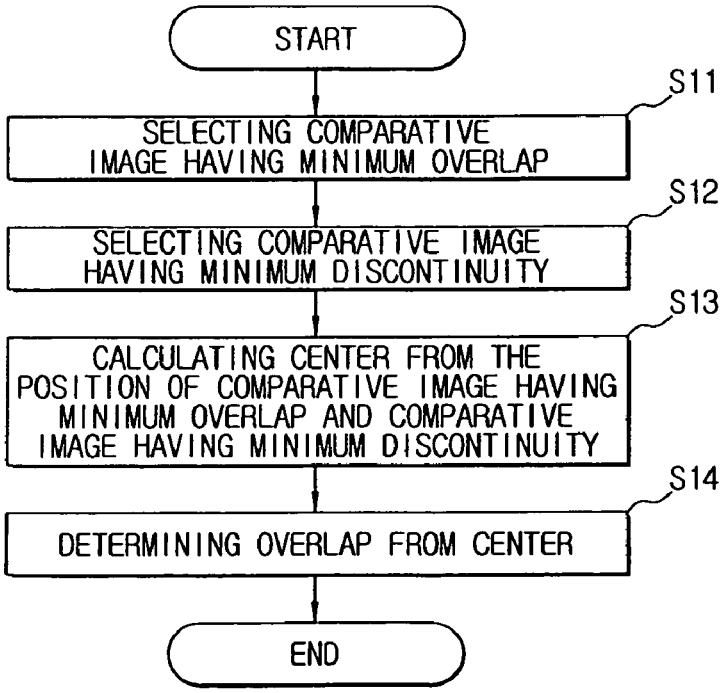
FIG. 5B is a flowchart illustrating a method of adjusting the print heads in the widthwise direction with reference to the first output pattern image of FIG. 5A.

FIG. 5A shows an exemplary enlarged view of a part of a first output pattern image 200' corresponding to the enlarged view of a part of the first input pattern image 200 in FIG. 4B. FIG. 5B is an exemplary flowchart explaining a method of adjusting the print heads in the widthwise direction with reference to the first output pattern image 200' of FIG. 5A. More particularly, FIG. 5A shows a part of a first output pattern image 200' practically outputted on a paper P when an image data corresponding to the first input pattern image 200 as shown in FIG. 4B is inputted to the inkjet cartridge 100 in the image forming apparatus (not shown). Similar to the first input pattern image 200, the first output pattern image 200' also includes a plurality of corresponding comparative unit images (e.g., 210' through 216'), which are derived from the corresponding comparative unit images (e.g., 210 through 216) in the respective input pattern image 200 based on the overlap among the print heads. The output pattern image 200' also includes numerical values representative of discontinuous areas in the comparative unit images therein as can be seen from the exemplary FIG. 5A.

As shown in FIG. 5A, a user or a printer service person may review the first output pattern image 200' with naked eyes or a scanner scans the first output pattern image so as to calculate a practical overlap value between the two heads Head #2 and Head #3. Although only two heads (Head #2 and Head #3) are shown in FIG. 5A, it is evident to one skilled in the art that these heads are shown as being representative of each pair of heads in the inkjet cartridge. Hence, all of the exemplary heads (Head #1 through Head #13) are not shown for the sake of brevity and ease of illustration. An exemplary method is shown in the flowchart in FIG. 5B to calculate the overlap value. Initially, a comparative image 210' having a minimum overlap is first selected from among all the comparative images 210', 211', 212', . . . , and 216' of the first output pattern image 200' (S11). Then, a comparative image 212' having a minimum discontinuous area is selected (S12). Then, a comparative image 211' positioned between the comparative image 210' having the minimum overlap and the comparative image 212' having the minimum discontinuous area is selected (S13). Then, the numerical value 1, 2, or 3 indicated as corresponding to the selected comparative image is chosen as the estimation of the practical overlap value (S14). That is, as shown in FIG. 5B, in the selected comparative image 211', an overlapped area or a discontinuous area is substantially minimally produced or such an area is not produced. Therefore, it may be sufficient if the numeral "1" is estimated as the practical overlap value for the corresponding pair of print heads (here, Head #2 and Head #3), wherein the numeral "1"

is the theoretical overlap value provided at a position corresponding to the selected comparative image 211'.

Figure 6A:
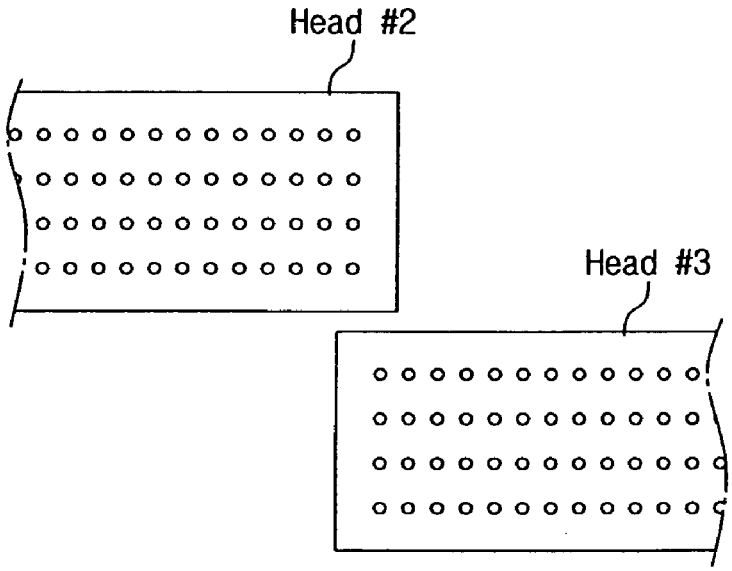
FIG. 6A illustrates the arrangement of two print heads set by the first input pattern image of FIG. 4B.
Figure 6B:
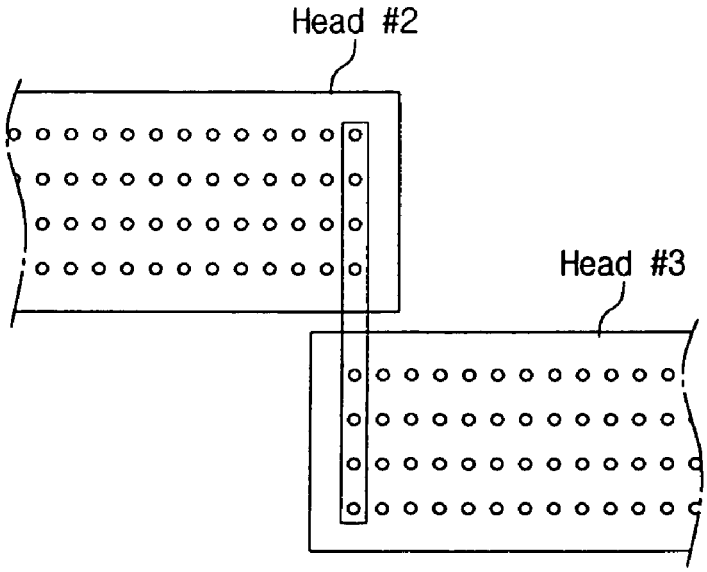
FIG. 6B illustrates the arrangement of the print heads in FIG. 6A adjusted using the method depicted in the flowchart in FIG. 5B.

FIG. 6A shows an exemplary arrangement of two print heads (e.g., Head #2 and Head #3) set by the first input pattern image 200 of FIG. 4B, and FIG. 6B shows an exemplary arrangement of the print heads adjusted using the method depicted in the flowchart in FIG. 5B. In the embodiment of FIG. 6A, the pattern image 200 as shown in FIG. 4B may be the output pattern image when the two neighboring heads Head #2 and Head #3 are arranged in a state in which the nozzles thereof are not overlapped with each other in the widthwise direction A. Whereas, it can be appreciated that the practically output pattern image 200' as shown in FIG. 5A may be produced from the neighboring heads Head #2 and Head #3, which are arranged in a state in which one array of nozzles in each of these neighboring heads are overlapped with each other in the widthwise direction A as shown in FIG. 6B.

On the basis of the above-mentioned result obtained using the method illustrated in FIG. 5B, the user or a printer service person can estimate the overlap value between the two heads (here, the Head #2 and the Head #3) to be equal to "1." In this manner, the overlap value for each pair of neighboring heads can be estimated to adjust the overlap. The overlap value can be easily set (to correct the overlap in future printing operations) by inputting the estimated value into, for example, the printer driver through a personal computer (PC) or the like, or directly into the inkjet printer itself (if possible).

It is noted here that the print heads Head #1 through Head #13 may not be arranged in a line in the widthwise direction A and may be arranged in a zigzag form in the paper feeding direction B. The neighboring print heads can be overlapped with each other by a predetermined area (e.g., by a predetermined number of nozzles). Therefore, as described above, it may be important to control the overlap or discontinuity of widthwise unit images formed by neighboring print heads as well as to control horizontal orientation of respective widthwise unit images so as to output them on a same line in the widthwise direction A. The method discussed hereinbefore with respect to FIGS. 4A through 5B may be used to control such overlaps to accomplish desired head adjustments in the widthwise direction A.

In fact, it may be possible to output images which are consistent and continuous in the widthwise direction A by controlling the timing of ink ejections for each of the print heads 150 when a paper P is fed in the paper feeding direction B. However, because the respective print heads 150 may not be in the proper horizontal alignment from each other due to tolerances (or the like) produced in manufacturing and assembling them, it may be needed to adjust the print heads 150 to be in the horizontal alignment.

Another embodiment of the present general inventive concept relates to an adjustment method for aligning images formed by the print heads (e.g., Head #1 to Head #13) to be coincident with each other in the feeding direction B of a print medium. This embodiment is described in detail below.

When the coincidence, i.e., the alignment between a pair of print heads (e.g., the Head #1 and the Head #2) in the print medium feeding direction B is needed to be set for the first time or reset as in the case when a product (e.g., an inkjet printer with such print heads) is delivered from a warehouse, or after a service person or a user repairs the product due to a trouble, or when at least one print head of the product is changed, a theoretical pattern image (hereinafter, to be referred to as the second input pattern image), which is previously set, may be used for the horizontal adjustment. Similar to the first input pattern image 200, the second input pattern image (e.g., the pattern image 300 in FIG. 4A and discussed hereinbelow) may be provided by being previously set prior to delivering an image forming apparatus from the warehouse and may be stored in a memory incorporated in the image forming apparatus or provided through a driver (e.g., printer driver software) of the image forming apparatus.

Figure 7A:
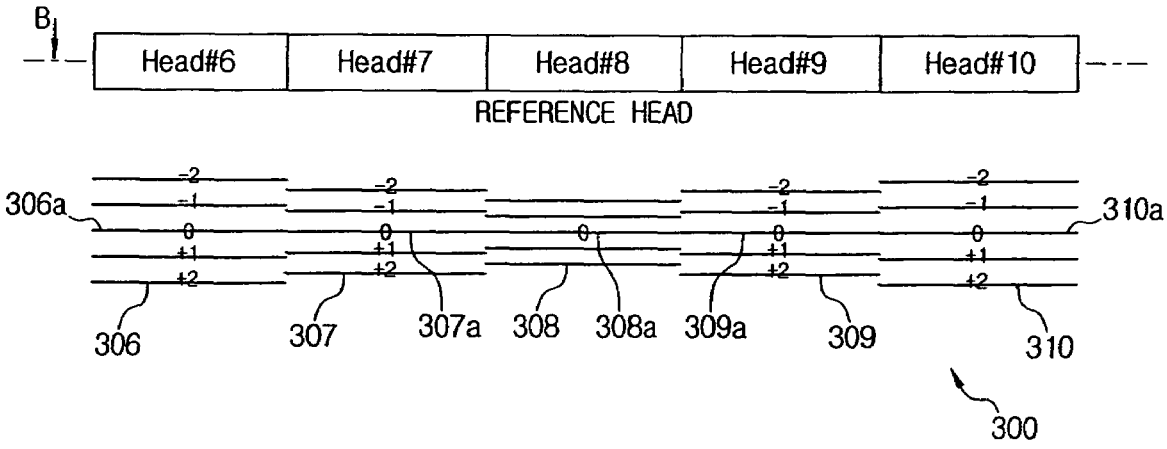
FIG. 7A is an enlarged view of a part of the second input pattern image shown in FIG. 4A.
Figure 7B:
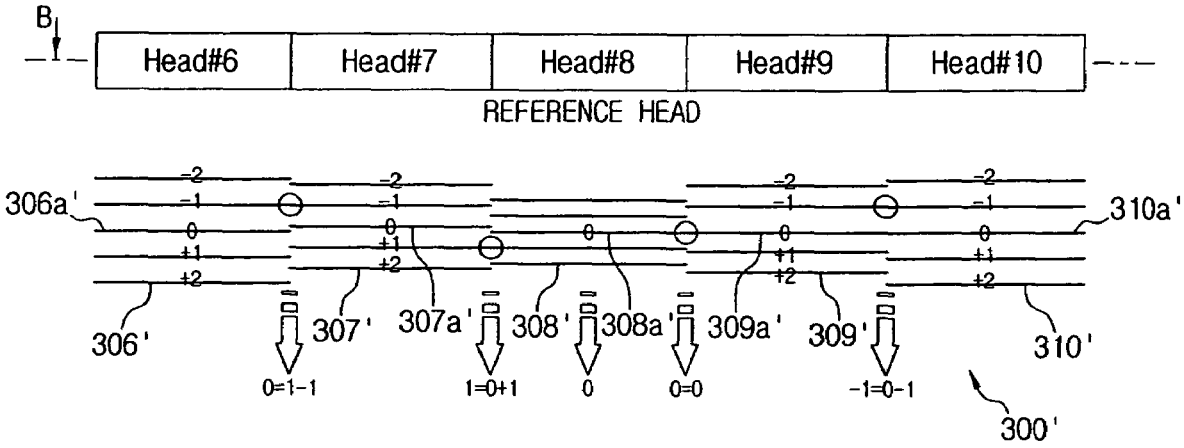
FIG. 7B is an enlarged view of a part of a second output pattern image corresponding to the enlarged view of a part of the second input pattern image in FIG. 7A.
Figure 7C:
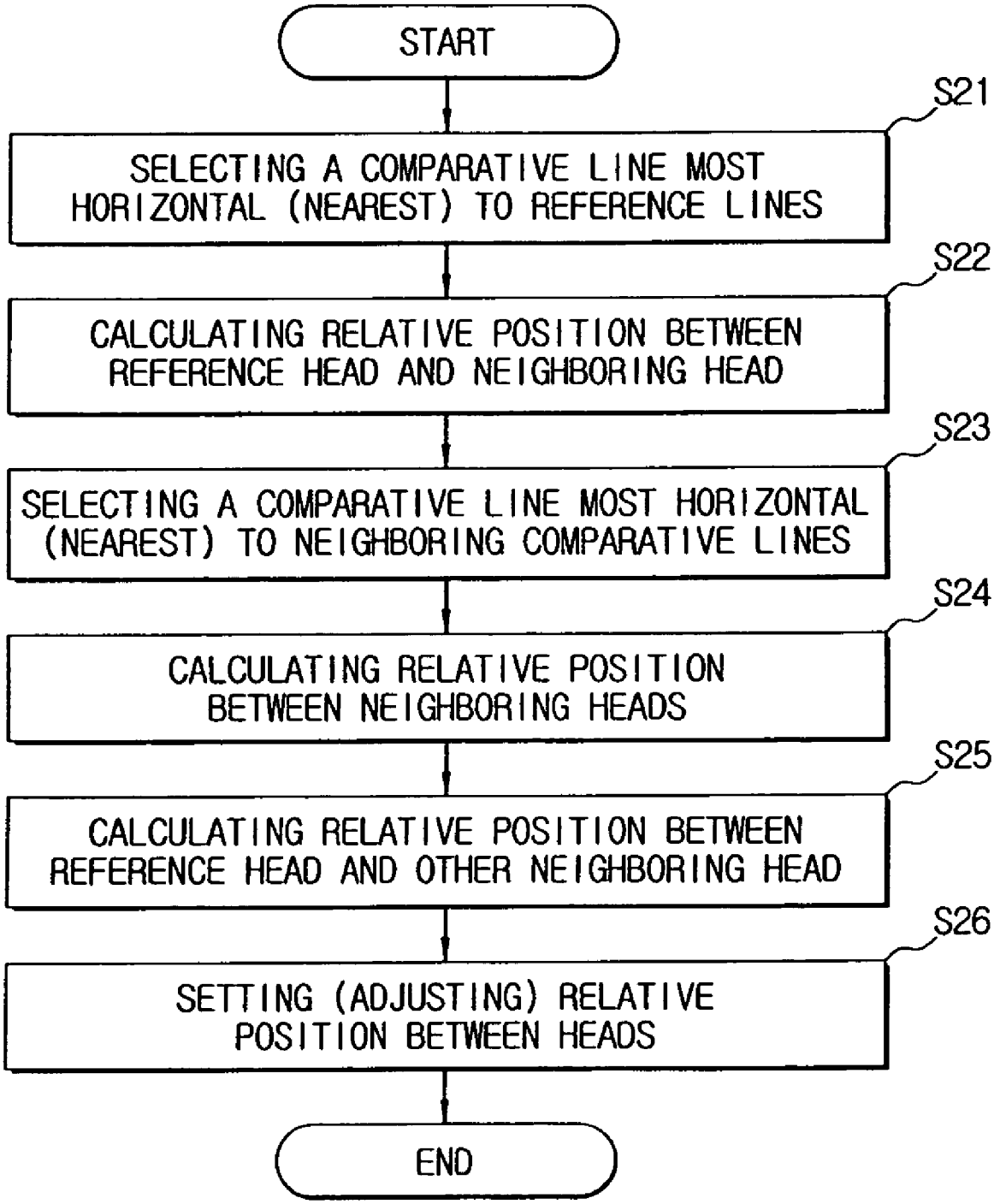
FIG. 7C is a flowchart illustrating a method of adjusting alignment between print heads in the print medium feeding direction with reference to the second output pattern image of FIG. 7B.

In FIG. 4A, reference numeral 300 denotes the second input pattern image which is theoretically set, wherein the second input pattern image 300 can be outputted on a paper along with or instead of the first input pattern image 200. Alternatively, only one of the two input pattern images 200 and 300 may be output on the paper without outputting the other of the two input pattern images depending on the adjustment operations desired. FIG. 7A is an exemplary enlarged view of a part of the second input pattern image 300 shown in FIG. 4A; FIG. 7B is an exemplary enlarged view of a part of a second output pattern image 300' corresponding to the enlarged view of the part of the second input pattern image 300 in FIG. 7A; and FIG. 7C shows an exemplary flowchart explaining a method of adjusting alignment between print heads in the print medium feeding direction with reference to the second output pattern image 300' of FIG. 7B. As shown in FIG. 7A, the second input pattern image 300 may include a plurality of reference lines 308 to be formed by a reference head (e.g., the Head #8) and a plurality of comparative lines 307, 306, . . . , etc. and 309, 310, . . . , etc. to be formed by heads (e.g., Head #7, Head #6, . . . etc.) on the left side of the reference head (here, Head #8) and heads (e.g., Head #9, Head #10, . . . , etc.) on the right side of the reference head, respectively.

Any print head can be pre-selected as a reference head. The reference lines 308 are prepared in a pattern having a constant interval (i.e., constant timing interval) therebetween in the print medium feeding direction "B".

The comparative lines 307 and 309 to be formed by the seventh and the ninth heads Head #7 and Head #9, respectively, are provided in a pattern having a constant interval (constant timing interval) in the "B" direction. However, among the comparative lines 307 and 309, only the center lines 307*a* and 309*a* are centrally positioned in the "B" direction and are set to be coincidently connected with a corresponding central reference line 308*a* in the widthwise direction "A" as shown in FIG. 7A. The remaining comparative lines in the comparative lines 307 and 309 are provided in a pattern having an early interval (early timing) or a late interval (late timing) by a predetermined unit interval (predetermined unit timing interval) in the "B" direction in relation to the corresponding reference lines, wherein the corresponding reference lines are those reference lines that neighbor with the respective remaining comparative lines and become the objects to be compared with those remaining comparative lines. For example, the comparative lines 307 and 309 are formed in a pattern having time differences of . . . , +2t, +1t, 0t, −1t, −2t, . . . as compared with the corresponding lines in the neighboring reference lines 308. The time difference of a unit time interval in the "B" direction is designated as "t" in the above values. Therefore, only the central lines 307*a* and 309*a*, the unit intervals of which are 0t, can be considered linearly coincident with the corresponding reference line 308*a* in the widthwise direction "A". In addition, for the comparative lines 307 and 309 to be compared with the reference lines 308, each of the above mentioned unit intervals is introduced into the second input pattern image 300.

In the same manner as described above, other neighboring comparative lines 306 and 310 are set in a pattern having time differences of . . . , +2t, +1t, 0t, −1t, −2t, . . . as compared with their immediate neighboring comparative lines 307 and 309, respectively. Thus, in case of comparative lines 306 and 310, the comparative lines 307 and 309, respectively, are employed as the reference lines and the unit interval (unit time interval t) based time difference measurements in the "B" direction are similarly carried out.

Thus, in the exemplary second input pattern image 300, the central reference line 308*a* is coincidently connected with the central lines 306*a*-307*a* of the comparative lines 306-310 in the widthwise direction "A", and the other comparative lines are set to have intervals of . . . , +2t, +1t, 0t, −1t, −2t, . . . as compared with their respective neighboring reference lines. As before, the unit interval is given by reference letter "t."

The second input pattern image 300 is theoretically determined and can be inputted through a memory of an image forming apparatus or through a driver of the image forming apparatus, like the first input pattern image 200. It is noted here that the enlarged view of the relationship among the lines in FIG. 7A is not clearly visible in the less-detailed view of the second input pattern image 300 in FIG. 4A. However, a print-out of the reference and the comparative lines (as shown, for example, in FIG. 7B) may clearly depict the relationships among the lines.

In operation, using the above-mentioned theoretical second input pattern image 300, each of the heads (e.g., Head #1 to Head #13) outputs a practical pattern image on a paper. FIG. 7B shows a practically outputted second output pattern image 300', which is based on the above-mentioned second input pattern image 300.

Referring to FIG. 7B, the second output pattern image 300' may be formed in a pattern somewhat different from that of the second input pattern image 300, which is theoretically determined. That is, the practically outputted reference lines 308', which are outputted on the basis of the reference head (here, the Head #8), are formed in the same pattern as the inputted reference lines 308. However, the comparative lines 306' and 307'; and 309' and 310' in FIG. 7B outputted by the other heads Head #7 and Head #8; Head #9 and Head #10 are different from the corresponding comparative lines 306 and 307; and 309 and 310 in the second input pattern image 300. In any event, the second output pattern image 300' also includes a plurality of reference lines 308' (similar to the reference lines 308) and a second plurality of comparative lines 306', 307', 309', etc., which are derived from the corresponding first plurality of comparative lines 306, 307, 309, etc. in the theoretical second input pattern image 300. Also, the placement of the second plurality of comparative lines 306', 307', 309', etc. with reference to the corresponding reference lines 308' may depend on the relative positions of the reference print head and each of the remaining non-reference print heads. The unit time interval ("t") based numerical values may also be provided for the lines in the second output pattern image 300' as shown in FIG. 7B. By analyzing the second output pattern image 300,' which is practically outputted on the basis of the second input pattern image 300, it is possible to practically find the relative positions of the mechanically arranged heads (e.g., Head #1 to Head #13). An exemplary procedure for determination of such relative positions is described in more detail with reference FIG. 7C.

Referring now to FIG. 7C, at first, the comparative lines 307*a*' and 309*a*', which are most horizontally aligned with the corresponding reference line 308*a*', are selected (S21). In other words, from among the comparative lines 306-310, the comparative lines 307' and 309' of the heads Head #7 and Head #9, which are immediately next to the reference head Head #8, only those comparative lines (here, lines 307*a*' and 309*a*') which are most horizontal to the corresponding reference line 308*a*' in the reference set of lines 308', are selected (S21).

Then, relative positions between the reference head Head #8 and the neighboring heads Head #7 and Head #9 are determined through the selected comparative lines 307*a*' and 309*a*' and the corresponding reference line 308*a*' (S22). Here, it can be seen from FIG. 7B that the relative position between the most horizontal comparative line 307*a*' of the left side head Head #7 and the reference line 308*a*' of the reference head Head #8 is, for example, "+1" as indicated in FIG. 7B. In addition, the relative position between the most horizontal comparative line 309*a*' of the right side head Head #9 and the reference line 308*a*' of the reference head Head #8 is "0" as indicated by a circle in FIG. 7B. Therefore, the alignment adjustment value for the left side head Head #7 in relation to the reference head Head #8 in the "B" direction (paper feeding direction) will be "+1" and the alignment adjustment value for the right side head Head #9 will be "0". In other words, it can be understood that the position of the right side head Head #9 has been determined to be needing no adjustment in the "B" direction.

Next, for other heads Head #6 and Head #10 next to the heads Head #7 and Head #9, respectively, the relative positions of these other heads are calculated in relation to the reference head Head #8. As part of such relative position determination, the comparative lines 306*a*' and 310*a*', which are most horizontal to the corresponding comparative lines 307*a*' and 309*a*' (which are now serving as reference lines to the lines 306*a*' and 310*a*'), are selected with reference to the comparative lines 307*a*' and 309*a*', respectively (S23).

Then, in the same manner as the operation S22, the relative positions between the heads Head #6 and Head #7 and between the heads Head #9 and Head #10 are calculated (S24). Referring to FIG. 7B, the most horizontal comparative lines between the heads Head #6 and Head #7, which are positioned at the left side of the reference head Head #8, have a reference value of, for example, "−1." Through the second output pattern image 300', it can be also appreciated that the most horizontal comparative lines between the heads Head #9 and Head #10, which are positioned at the right side of the reference head Head #8, have a reference value of, for example, "−1."

Next, the relative positions of these otherheads Head #6 and Head #10 in relation to the reference head Head #8 are calculated (S25). Here, because the relative position between the heads Head #6 and Head #7 is "−1" and the relative position between the heads Head #7 and Head #8 is "+1," the relative position (or reference value) between the heads Head #6 and Head #8 equals to "0" (1−1=0) as indicated in FIG. 7B. On the other hand, because the relative position between the heads Head #9 and Head #10 is "−1" and the relative position between the heads Head #8 and Head #9 is "0," the relative position (or reference value) between the heads Head #8 and Head #10 equals to "−1" (−1=0−1) as also indicated in FIG. 7B.

After the relative positions (reference values) of the other neighboring heads Head #6 and Head #7 and Head #9 and Head #10 are determined or estimated in relation to the reference head Head #8, the alignment of the heads is adjusted in relation to the "B" direction (paper feeding direction) on the basis of the calculated/estimated relative positions (S26). Similarly, the process of steps S23 through S26 can be repeated for each non-reference head that is progressively farther away in either direction of the reference head. The estimated relative position values in operation S26 can be determined (e.g., by a user or a service person) and inputted through a PC or a driver (e.g., a printer driver software for the inkjet printer whose heads are to be adjusted) in the same manner as the above-mentioned head adjustment method in the widthwise direction A of the print medium.

By calculating and adjusting practical intervals of the heads (e.g., Head #1 to Head #13) in the "B" direction (i.e., the paper feeding direction) as described above with reference to FIGS. 7A-7C, it is possible to minimize the image error of a practically outputted image (i.e., an image that is to be printed during an actual print operation) in the "B" direction.

A head adjustment method according to a third embodiment of the present general inventive concept relates to adjusting the heads 150 in both of the widthwise direction A and the paper feeding direction B, which can be accomplished by sequentially performing the head adjustment methods of the first and second embodiments. As noted before, only one or both of these head adjustments methods may be performed as desired.

That is, as shown in FIG. 4A, image data for the first and the second input pattern images 200 and 300 are set to be outputted on a single paper, and then the first and the second output pattern images 200' and 300' as shown in FIGS. 5A and 7B are outputted in unison on a single print medium. Then, the positions of the heads 150 in relation to the widthwise direction A and the paper feeding direction B are adjusted on the basis of the outputted first and second output pattern images 200' and 300', respectively. Therefore, it is possible to adjust the heads in such a manner as to minimize the overlap and discontinuity in the widthwise direction A of an outputted image while minimizing the discontinuity in the print medium feeding direction B.

Although in the above-mentioned embodiments the number of the arranged print heads 150 are thirteen (from the first head Head #1 through the thirteenth head Head #13), it is evident to one skilled in the art that the total number of heads are selected as a convenient example to discuss the teachings of the present general inventive concept. In practice, the total number of heads may vary from one image forming apparatus to another.

The head adjustment methods discussed hereinabove can be efficiently applied to adjust an array of heads (in the widthwise and feeding directions A and B, respectively, of a paper) in a so-called array head type image forming apparatus, in which a plurality of print heads are arranged in the widthwise direction A of a paper.

Figure 8:
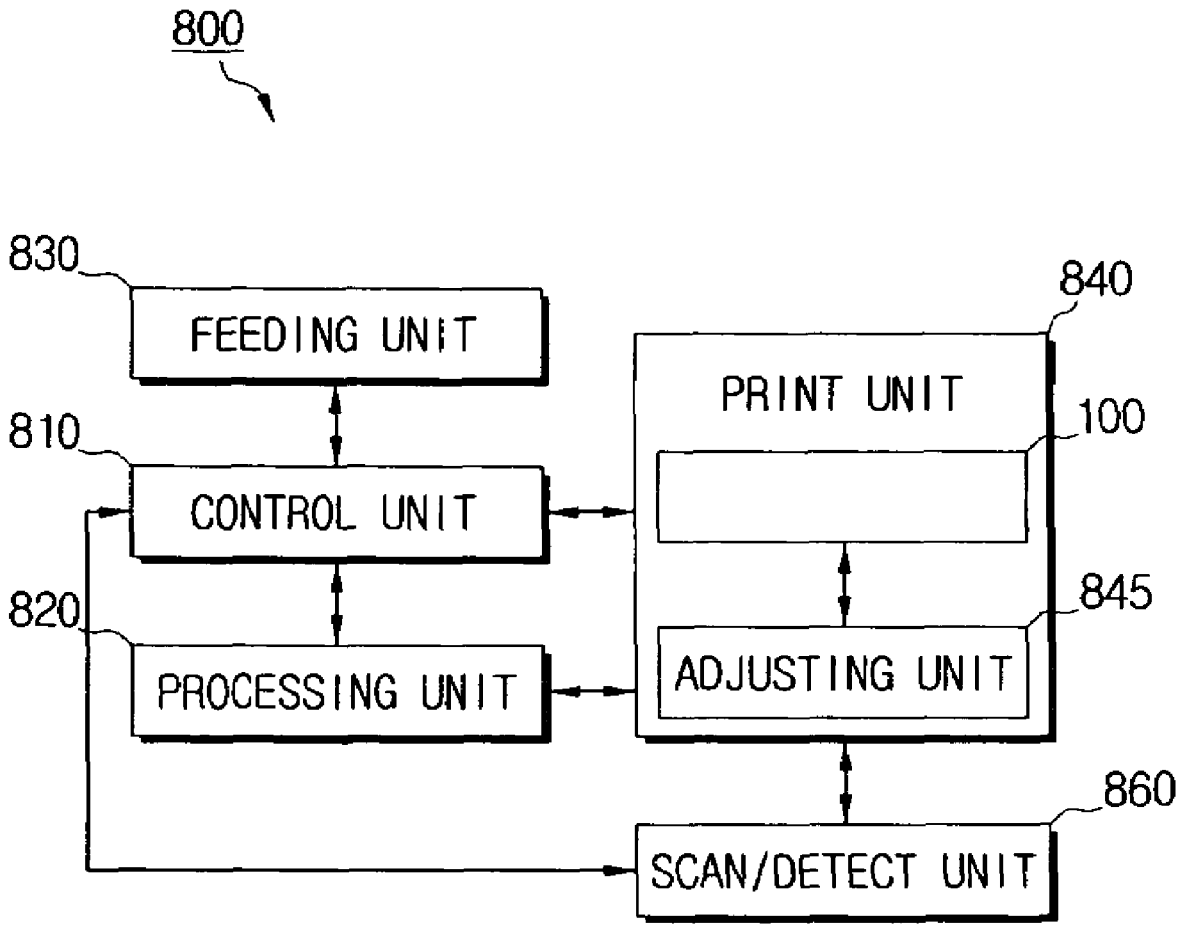
FIG. 8 is a view illustrating an image forming apparatus according to an embodiment of the present general inventive concept.

FIG. 8 is a view illustrating an image forming apparatus 800 according to an embodiment of the present general inventive concept. The image forming apparatus 800 may include the ink cartridge 100 of FIG. 1 to perform the methods of FIGS. 5B and 7C. Referring to FIGS. 1-8, the image forming apparatus 800 includes an image processing unit to process an input signal to generate an image signal to print on a print medium an image corresponding to the image signal and/or the first and second output pattern images of the first and second input pattern images of FIGS. 4A, 4B, 5A, 7A, and 7B, a feeding unit 830 to feed the print medium in a feeding direction to print the image, a print unit 840 to print the image one the fed print medium and having the ink cartridge 100 and an adjusting unit 845 to adjust overlap and/or relative position of the print heads of the cartridge 100, a scanning and/or detecting unit 860 to scan and detect the printed image from the print medium, and a control unit 810 to control components of the image forming apparatus 800.

As described above, the print heads arranged in the widthwise direction of a print medium can be adjusted either in the widthwise direction of the paper or in the paper feeding direction. In particular, because the inventive head adjustment method can be accomplished by outputting a pattern image on a paper one time and adjusting the intervals and relative positions of the print heads in the widthwise direction and print medium feeding directions, the adjustment method is easy and simple to perform.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A head adjustment method of adjusting overlaps of a plurality of print heads, which are arranged in a widthwise direction of a print medium in an image forming apparatus, in the widthwise direction, the method comprising:

setting a theoretical input pattern image to be formed by the print heads by theoretically setting discontinuous areas between widthwise unit images formed by the neighboring print heads positioned next to each other, respectively, and forming a plurality of comparative unit images, which include the widthwise unit images, in accordance with a time difference along a feeding direction of the print medium;

outputting a practical output pattern image onto the print medium by driving the print heads according to the input pattern image;

estimating practical overlap values of the print heads through the output pattern image; and adjusting degrees of overlap between the print heads according to the estimated overlap values, wherein the discontinuous areas between the comparative unit images vary from each other.

2. The head adjustment method as claimed in claim 1, wherein the setting of the discontinuous areas comprises determining the theoretical discontinuous areas between the widthwise unit images based on the assumption that there is zero (0) overlap of nozzles of the neighboring print heads in the widthwise direction.

3. The head adjustment method as claimed in claim 1, wherein the forming of the plurality of comparative unit images comprises varying the discontinuous areas between the neighboring comparative unit images from each other based on the individual nozzle unit of the print heads.

4. The head adjustment method as claimed in claim 1, wherein the setting of the theoretical input pattern image further comprises:

introducing a boundary line, which is representative of a boundary between the widthwise unit images of each of the comparative unit images, into the input pattern image.

5. The head adjustment method as claimed in claim 1, wherein the setting of the discontinuous areas comprises determining comprises:

introducing numerical values, each of which is representative of a unit of a discontinuous area of each of the comparative unit images, into the input pattern image.

6. The head adjustment method as claimed in claim 1, wherein the estimating of the practical overlap values of the print heads comprises:

selecting a widthwise unit image having one or more minimum overlaps among the comparative unit images of the output pattern image;

selecting a comparative unit image having one or more minimum discontinuous areas among the comparative unit images of the output pattern image;

selecting a comparative unit image corresponding to an intermediate position between the comparative image having the minimum overlaps and the comparative unit image having the minimum discontinuous areas; and determining a discontinuous area of the comparative unit image of the intermediate position as a practically referenced discontinuous area.

7. The head adjustment method as claimed in claim 6, wherein the output pattern image includes numerical values, each of which is indicative of a unit of a discontinuous area of each of the outputted comparative unit images.

8. The head adjustment method as claimed in claim 7, wherein the adjusting of the degrees of overlap comprises incorporating a numerical value indicated as corresponding to the comparative unit image of the intermediate position to adjust practical discontinuous areas of the neighboring print heads.

9. The head adjustment method as claimed in claim 1, wherein the output pattern image comprises comparative unit images having color bar images formed in the widthwise direction.

10. The head adjustment method as claimed in claim 1, wherein the print heads are arranged in an array type.

11. A head adjustment method of adjusting a plurality of print heads arranged in an widthwise direction in an image forming apparatus such that unit images formed by the print heads are coincidentally connected with each other in a feeding direction of a print medium, the method comprising:

setting a theoretical input pattern image to be formed by the print heads by:

setting one of the print heads as a reference head;

setting a plurality of reference lines to be formed at intervals in the feeding direction by the reference head; and setting a plurality of comparative lines to be formed in the feeding direction by another one of the print heads next to the reference head to compare with the reference head, in such a manner that the comparative lines have phases in relation to the neighboring reference lines in the feeding direction, the phases of neighboring comparative lines being different from each other according to a predetermined unit;

outputting a practical output pattern image on the print medium by driving the print heads according to the input pattern image;

estimating relative positions of the print heads in the feeding direction through the output pattern image; and adjusting positions of the print heads in the feeding direction according to the estimated relative positions.

12. The head adjustment method as claimed in claim 11, further comprising:

numerically expressing and setting phase differences of the phases of the comparative lines next to the reference lines, so that the numerical values of the phase differences are indicated in the input pattern image.

13. The head adjustment method as claimed in claim 12, wherein the setting of the plurality of comparative lines comprises setting the comparative lines to be formed by the head next to the reference head such that the comparative lines are classified into minus phase difference lines and plus phase difference lines that are positioned before and after a center line in the feeding direction, respectively, the center line being coincident with a corresponding one of the reference lines.

14. The head adjustment method as claimed in claim 13, wherein the plus and minus phase differences are set such that the phase differences are increased by a predetermined unit according to a distance from the central comparative line.

15. The head adjustment method as claimed in claim 12, wherein the estimating of the relative positions of the print heads comprises:

selecting one of the comparative lines which is most horizontal in relation to a corresponding reference line; and finding a numerical value corresponding to the selected comparative line to calculate the relative positions between the reference head and the neighboring heads.

16. The head adjustment method as claimed in claim 12, wherein the print heads are arranged in an array type.

17. The head adjustment method as claimed in claim 13, wherein the setting of the input pattern image further comprises:

setting a plurality of second comparative lines having second phases differences which are different from each other in the feeding direction to other print heads disposed next to each other; and setting the second phase differences of the print heads next to each other so that the second phase differences are numerically expressed.

18. The head adjustment method as claimed in claim 17, wherein the estimating of the relative positions of the print heads comprises:

selecting one of the second comparative lines which is most horizontal in relation to a corresponding reference line;

finding a numerical value corresponding to the selected second comparative line to calculate relative positions between the reference head and the neighboring heads;

selecting the second comparative lines which are most horizontal to each other between the neighboring heads;

calculating the relative positions between the neighboring heads on the basis of numerical values corresponding to the second comparative lines selected between the neighboring heads; and calculating another relative positions between the reference head and the another print heads next to the reference head in the widthwise direction on the basis of the calculated relative positions.

19. A head adjustment method of adjusting a plurality of print heads arranged in an image forming apparatus in a widthwise direction of a print medium, the method comprising:

adjusting overlaps of print heads in a widthwise direction of a print medium by setting a first theoretical input pattern image to be formed by the print heads, outputting a first practical output pattern image on the print medium by driving the print heads according to the input pattern image, estimating practical overlap values of the print heads through the first output pattern image, and adjusting degrees of overlap between the print heads according to the estimated overlap values; and adjusting relative positions between the print heads in a feeding direction of the print medium, wherein the setting of the first theoretical input pattern image comprises:

theoretically setting discontinuous areas between widthwise unit images formed by the neighboring print heads positioned next to each other, respectively, and forming a plurality of comparative unit images, which include the widthwise unit images according to a time difference along a feeding direction of the print medium; and the discontinuous areas between the comparative unit images vary from each other.

20. The head adjustment method as claimed in claim 19, wherein the setting of the discontinuous areas comprises determining the theoretical discontinuous areas between the widthwise unit images when there is zero (0) overlap of nozzles of the neighboring print heads in the widthwise direction.

21. The head adjustment method as claimed in claim 19, wherein the setting of the discontinuous areas comprises:

introducing a boundary line, which is representative of a boundary between the widthwise unit images of each of the comparative unit images, into the first input pattern image.

22. The head adjustment method as claimed in claim 19, wherein the setting of the discontinuous areas comprises:

introducing numerical values, each of which is representative of a unit of a discontinuous area of each of the comparative unit images, into the first input pattern image.

23. The head adjustment method as claimed in claim 19, wherein the estimating of the practical overlap values comprises:

selecting a widthwise unit image having one or more minimum overlaps among the comparative unit images of the first output pattern image;

selecting a comparative unit image having one or more minimum discontinuous areas among the comparative unit images of the first output pattern image;

selecting a comparative unit image corresponding to an intermediate position between the comparative image having the minimum overlaps and the comparative unit image having the minimum discontinuous areas; and determining discontinuous areas of the comparative unit image of the selected intermediate position as a practically referenced discontinuous area.

24. The head adjustment method as claimed in claim 23, wherein the first output pattern image includes numerical values, each of which is indicative of a unit of a discontinuous area of each of the outputted comparative unit images.

25. The head adjustment method as claimed in claim 19, wherein the adjusting of the relative positions comprises:

setting a theoretical second input pattern image to be formed by the print heads;

outputting a practical second output pattern image on the print medium by driving the print heads according to the second input pattern image;

estimating relative positions of the print heads in the feeding direction through the second output pattern image; and adjusting positions of the print heads in the feeding direction according to the estimated relative positions.

26. The head adjustment method as claimed in claim 25, wherein the setting of the second input pattern image comprises:

setting one of the print heads as a reference head;

setting a plurality of reference lines to be formed at intervals in the feeding direction by the reference head;

setting a plurality of comparative lines to be formed in the feeding direction by another one of the print heads next to the reference head so as to be compared with the reference head, in such a manner that the comparative lines have phases in relation to the neighboring reference lines in the feeding direction, the phases of neighboring comparative lines being different from each other in a predetermined unit; and numerically expressing and setting phase differences of the phases of the comparative lines next to the reference lines, so that numerical values of the phase differences are indicated in the second input pattern image.

27. The head adjustment method as claimed in claim 26, wherein the setting of the plurality of comparative lines comprises setting the comparative lines to be formed by the head next to the reference head to be classified into minus phase difference lines and plus phase difference lines that are positioned before and after a center line in the print medium feeding direction, respectively, the center line being coincident with a corresponding one of the reference lines.

28. The head adjustment method as claimed in claim 27, wherein the plus and minus phase differences are set in such a manner as to be increased by a predetermined unit as going away from the central comparative line.

29. The head adjustment method as claimed in claim 26, wherein the estimating of the relative positions of the print heads comprises:

selecting one of the comparative lines which is most horizontal in relation to a corresponding reference line; and finding a numerical value corresponding to the selected comparative line to calculate relative positions between the reference head and the neighboring heads.

30. The head adjustment method as claimed in claim 27, wherein the setting of the second input pattern image comprises:

setting a plurality of second comparative lines having second phases differences which are different from each other in the feeding direction; and setting the second phase differences of the print heads next to each other to be numerically expressed.

31. The head adjustment method as claimed in claim 30, wherein the estimating of the relative positions of the print heads comprises:

selecting one of the second comparative lines which is most horizontal in relation to a corresponding reference line;

finding a numerical value corresponding to the selected second comparative line to calculate relative positions between the reference head and the neighboring heads;

selecting the second comparative lines which are most horizontal to each other between the neighboring heads;

calculating the relative positions between the neighboring heads on the basis of numerical values corresponding to the second comparative lines selected between the neighboring heads; and calculating another relative positions between the reference head and the another one of the prints heads next to the reference head in the widthwise direction on the basis of the calculated relative positions.

32. The head adjustment method as claimed in claim 19, wherein the print heads are arranged in an array type.

33. A head adjusting method of adjusting a plurality of print heads arranged in an image forming apparatus in a widthwise direction of a print medium, the method comprising:

setting a first input pattern image indicating overlaps of the print heads in the widthwise direction of the print medium and a second input pattern image indicating relative positions of the print heads in a feeding direction of the print medium; and outputting a first output pattern image and a second output pattern image on the print medium by driving the print heads according to the first input pattern image and the second input pattern image, respectively, to indicate actual overlaps of the print heads in the widthwise direction and actual relative positions of the print heads in the feeding direction.

34. The head adjustment method as claimed in claim 33, further comprising:

adjusting the actual overlaps and the actual relative positions of the print heads.

35. The head adjustment method as claimed in claim 33, wherein the first input pattern image comprises unit comparative images having a boundary between the adjacent print heads in the widthwise direction, and the second input pattern image comprises comparative lines disposed in the feeding direction.

36. The head adjustment method as claimed in claim 33, wherein the first input pattern image comprises a first unit comparative image formed by a portion of one of the print heads, and a second unit comparative image formed by a portion of the other one of the print heads disposed adjacent to the one of the print heads such that the first unit comparative image and the second unit comparative image are disposed opposite to each other with respect to a boundary line without a discontinuous area.

37. The head adjustment method as claimed in claim 36, further comprising:

outputting a first output pattern image on the print medium by driving the print heads according to the first input pattern image, wherein the first output pattern image includes the discontinuous area around the boundary line according to an arrangement state of the print heads in the widthwise direction.

38. The head adjustment method as claimed in claim 33, wherein the second input pattern image comprises first comparative lines disposed in the feeding direction to correspond to one of the print heads, and second comparative lines disposed in the feeding direction to correspond to the other one of the print heads disposed adjacent to the one of the print heads such that corresponding first and second comparative lines are in line with each other in the widthwise direction.

39. The head adjustment method as claimed in claim 38, further comprising:

outputting a second output pattern image on the print medium by driving the print heads according to the second input pattern image, wherein the second output pattern image comprises actual first comparative lines and actual second comparative lines, and corresponding actual first and second comparative lines are spaced-apart from each other to indicate an arrangement state of the print heads in the feeding direction.

40. A head adjusting method of adjusting a plurality of print heads arranged in an image forming apparatus in a widthwise direction of a print medium, the method comprising:

outputting an output pattern image to indicate overlaps states of the print heads, wherein the output pattern image comprises a first unit comparative image formed by a portion of one of the print heads, and a second unit comparative image formed by a portion of the other one of the print heads disposed adjacent to the one of the print heads such that the first unit comparative image and the second unit comparative image are disposed opposite to each other with respect to a boundary line with a discontinuous area to indicate an arrangement state of the print heads in the widthwise direction.

41. A head adjusting method of adjusting a plurality of print heads arranged in an image forming apparatus in a widthwise direction of a print medium, the method comprising:

outputting an output pattern image to indicate relative position states of the print heads, wherein the output pattern image comprises first comparative lines disposed in the feeding direction to correspond to one of the print heads, and second comparative lines disposed in the feeding direction to correspond to the other one of the print heads disposed adjacent to the one of the print heads such that corresponding ones of the first and second comparative lines are formed to have a distance in the feeding direction to indicate the relative position states of the print heads.

42. A head adjusting method of adjusting a plurality of print heads arranged in an image forming apparatus in a widthwise direction of a print medium, the method comprising:

setting a theoretical input pattern image to be formed by the print heads by theoretically setting discontinuous areas between widthwise unit images formed by the neighboring print heads positioned next to each other, respectively, and forming a plurality of comparative unit images, which include the widthwise unit images, in accordance with a time difference along a feeding direction of the print medium where the discontinuous areas between the comparative unit images vary from each other; and outputting a first output pattern image and a second output pattern image according to the set theoretical input pattern on the print medium by driving the print heads to indicate actual overlaps of the print heads in the widthwise direction and actual relative positions of the print heads in the feeding direction.

43. An image forming apparatus comprising:

a feeding unit to feed a print medium;

an ink cartridge having a print heads arranged in a widthwise direction of the printing medium; and a control unit to control the print heads to output an output pattern image to indicate overlaps states of the print heads, wherein the output pattern image comprises a first unit comparative image formed by a portion of one of the print heads, and a second unit comparative image formed by a portion of the other one of the print heads disposed adjacent to the one of the print heads such that the first unit comparative image and the second unit comparative image are disposed opposite to each other with respect to a boundary line with a discontinuous area to indicate an arrangement state of the print heads in the widthwise direction.

44. An image forming apparatus comprising:

a feeding unit to feed a print medium;

an ink cartridge having a print heads arranged in a widthwise direction of the printing medium; and a control unit to control the print heads to output an output pattern image to indicate relative position states of the print heads, wherein the output pattern image comprises first comparative lines disposed in the feeding direction to correspond to one of the print heads, and second comparative lines disposed in the feeding direction to correspond to the other one of the print heads disposed adjacent to the one of the print heads such that corresponding ones of the first and second comparative lines are formed to have a distance in the feeding direction to indicate the relative position states of the print heads.

45. An image forming apparatus comprising:

a feeding unit to feed a print medium;

an ink cartridge having a print heads arranged in a widthwise direction of the printing medium; and a control unit to set a theoretical input pattern image to be formed by the print heads by theoretically setting discontinuous areas between widthwise unit images formed by the neighboring print heads positioned next to each other, respectively, and to form a plurality of comparative unit images, which include the widthwise unit images, where the discontinuous areas between the comparative unit images vary from each other, and to control the print heads to output a first output pattern image and a second output pattern image on the print medium according to the set a theoretical input pattern image by driving the print heads to indicate actual overlaps of the print heads in the widthwise direction and actual relative positions of the print heads in the feeding direction.

* * * * *